US006079108A

United States Patent [19]

Lin

[11] Patent Number: 6,079,108

[45] Date of Patent: Jun. 27, 2000

[54] KNIFE HOLDER

[76] Inventor: Chin-Chih Lin, 58, Ma Yuan West St., Taichung, Taiwan

[21] Appl. No.: 09/157,157

[22] Filed: Sep. 18, 1998

[51] Int. Cl.[7] ..... A47F 5/16; B24B 3/54

[52] U.S. Cl. ..... 30/298.4; 211/70.7; 248/37.3

[58] Field of Search ..... 30/298.4; 211/70.7; 248/37.3

[56] References Cited

U.S. PATENT DOCUMENTS 4,423,552 1/1984 Bourgein et al. ..... 30/298.4
4,575,939 3/1986 Buchtel ..... 30/298.4
4,866,845 9/1989 McEvily ..... 30/298.4
5,245,756 9/1993 Howell et al. ..... 30/298.4

*Primary Examiner*—Hwei-Slu Payer

[57] ABSTRACT

A knife holder has a hollow casing, a positioning plate disposed in the hollow casing, and a base plate disposed on a bottom of the hollow casing. The base plate has a periphery recess. The positioning plate has a center hole, an oblong aperture, and a plurality of slot apertures. An oblong hole is formed on a top portion of the hollow casing. A plurality of slot apertures are formed on the top portion of the hollow casing. A post extends downward from the top portion of the hollow casing. The post has a threaded end inserted in the center hole and fastened by a nut. The hollow casing has a periphery flange engaging with the periphery recess.

4 Claims, 8 Drawing Sheets

KNIFE HOLDER

BACKGROUND OF THE INVENTION

The present invention relates to a knife holder. More particularly, the present invention relates to a kitchen knife holder which has a hollow casing made of thermosetting plastics.

A conventional knife holder is made of wood. The wooden knife holder is easily moist and mildewed. It is difficult to clean the interior of the wooden knife holder. Furthermore, insects such as ants and cockroaches may enter the conventional knife holder.

SUMMARY OF THE INVENTION

An object of the present invention is to provide a kitchen knife holder which has a hollow casing made of thermosetting plastics in order to prevent the hollow casing from being mildewed.

Another object of the present invention is to provide a kitchen knife holder which has a hollow casing made of thermosetting plastics with sandalwood powders, camphorwood powders, and camphor powders in order to prevent the hollow casing against insects such as ants and cockroaches.

Another object of the present invention is to provide a kitchen knife holder which has a fan and an electrothermal device to prevent the interior of the kitchen knife holder from being moist.

In accordance with a first preferred embodiment of the present invention, a knife holder comprises a hollow casing, a positioning plate disposed in the hollow casing, and a base plate disposed on a bottom of the hollow casing. The base plate has a periphery recess. The positioning plate has a center hole, an oblong aperture, and a plurality of slot apertures. An oblong hole is formed on a top portion of the hollow casing. A plurality of slot holes are formed on the top portion of the hollow casing. A post extends downward from an upper portion of the hollow casing. The post has a threaded end inserted in the center hole and fastened by a first nut. The hollow casing has a periphery flange engaging with the periphery recess. Four step flanges are disposed on four upper inner corners of the hollow casing to block the positioning plate. A separation plate is disposed on a lateral of the hollow casing. The separation plate has a plurality of through holes. A hollow seat is connected to the separation plate. A cell chamber is formed in the hollow seat. The cell chamber receives a cell. A cell chamber cover covers the cell chamber. A fan is disposed in the hollow seat. Two pillars are disposed in an inner periphery of the hollow seat. A switch is disposed on the hollow seat. An electrothermal device is confined between the pillars. The electrothermal device has two round apertures receiving the pillars. Two second nuts fasten the pillars and the electrothermal device together.

In accordance with a second preferred embodiment of the present invention, a knife holder comprises a hollow casing, a positioning plate disposed in the hollow casing, and a base plate disposed on a bottom of the hollow casing. The base plate has circular hole and a periphery recess. The positioning plate has a center hole, an oblong aperture, and a plurality of slot apertures. An oblong hole is formed on a top portion of the hollow casing. A plurality of slot holes are formed on the top portion of the hollow casing. A post extends downward from an upper portion of the hollow casing. The post has a threaded end inserted in the center hole and fastened by a first nut. The hollow casing has a periphery flange engaging with the periphery recess. Four step flanges are disposed on four upper inner corners of the hollow casing to block the positioning plate. A separation plate is disposed on a lateral of the hollow casing. The separation plate has a plurality of through holes. A hollow seat is connected to the separation plate. A cell chamber is disposed on the hollow seat. The cell chamber receives a cell. A cell chamber cover covers the cell chamber. A fan is disposed in the hollow seat. Two pillars are disposed in an inner periphery of the hollow seat. A switch is disposed on the hollow seat. An electrothermal device is confined between the pillars. The electrothermal device has two round apertures receiving the pillars. Two second nuts fasten the pillars and the electrothermal device together.

In accordance with a third preferred embodiment of the present invention, a knife holder comprises a hollow casing and an upper cover. The hollow casing comprises an upper periphery flange, a center hole, an oblong aperture, and a plurality of slot apertures. The upper cover comprises an oblong hole, a plurality of slot holes, and a periphery groove. A post extends downward from an upper portion of the upper cover. A post has a threaded end inserted in the center hole and fastened by a nut. The upper cover covers the hollow casing. The periphery flange engages with the periphery groove.

In accordance with a fourth preferred embodiment of the present invention, a knife holder comprises a hollow casing, an oblong hole formed on a top portion of the hollow casing. A plurality of slot holes formed on the top portion of the hollow casing. A post extends downward from an upper portion of the hollow casing. The post has a threaded end. The hollow casing has a periphery flange. A separation plate is disposed on a lateral of the hollow casing. The separation plate has two flanges and a plurality of through holes. A hollow seat is connected to the separation plate. A cell chamber is formed in the hollow seat. A fan is disposed in the hollow seat. Two pillars are disposed in an inner periphery of the hollow seat. A switch is disposed on the hollow seat. The hollow seat has a slant face. Two slide grooves are formed on the slant face to receive the flanges.

DETAILED DESCRIPTION OF THE INVENTION

Figure 1:
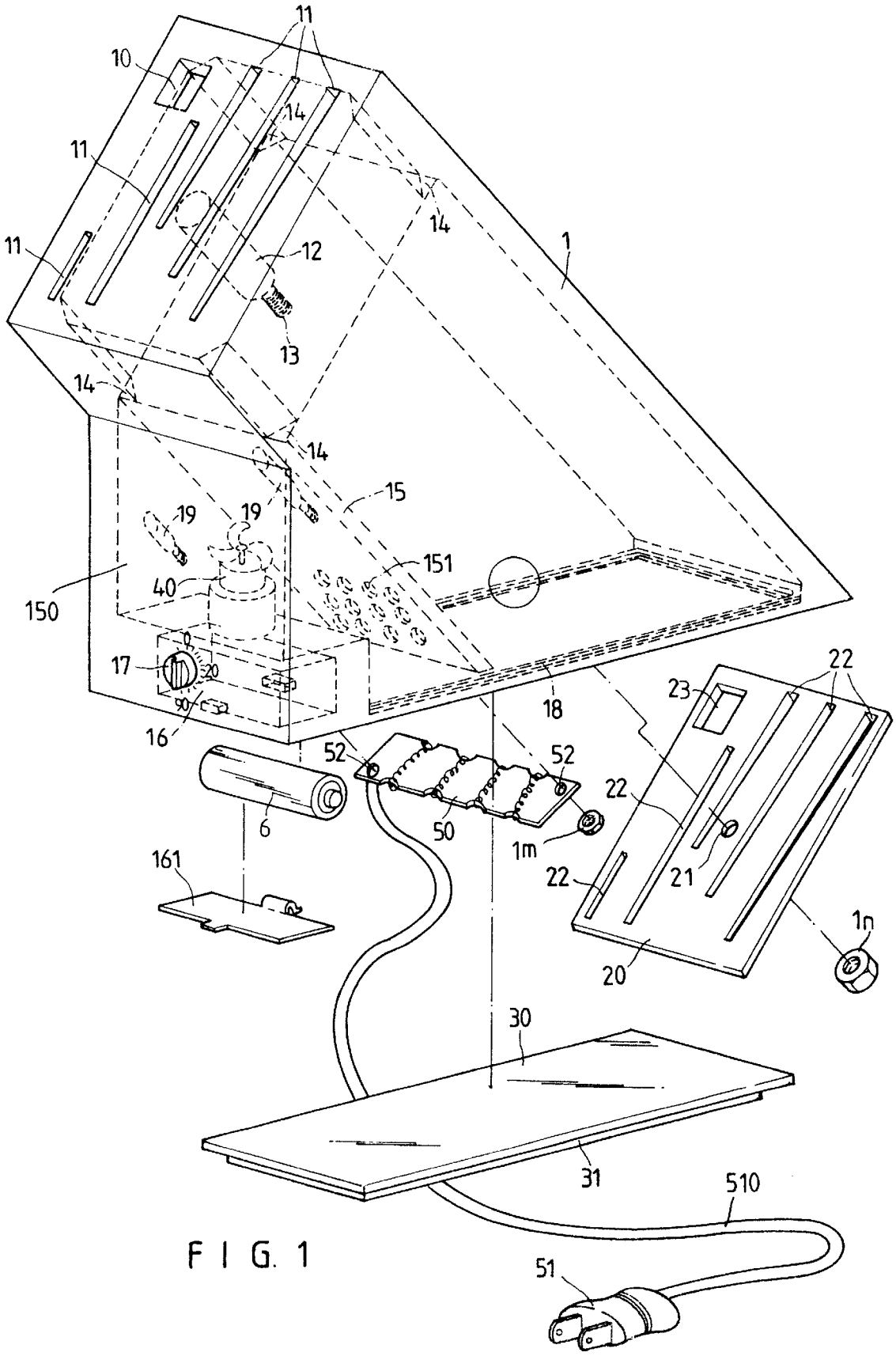
FIG. 1 is a perspective exploded view of a knife holder of a first preferred embodiment in accordance with the present invention.
Figure 1A:
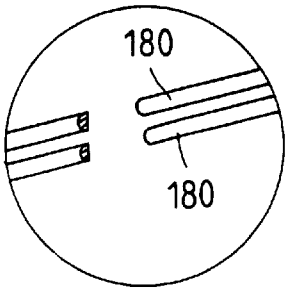
FIG. 1A is an enlarged perspective view of two protruded bars of a knife holder of a first preferred embodiment.
Figure 2A:
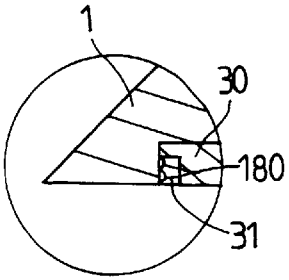
FIG. 2A is a schematic view illustrating an engagement of a protruded bar and a periphery recess in FIG. 2.
Figure 2:
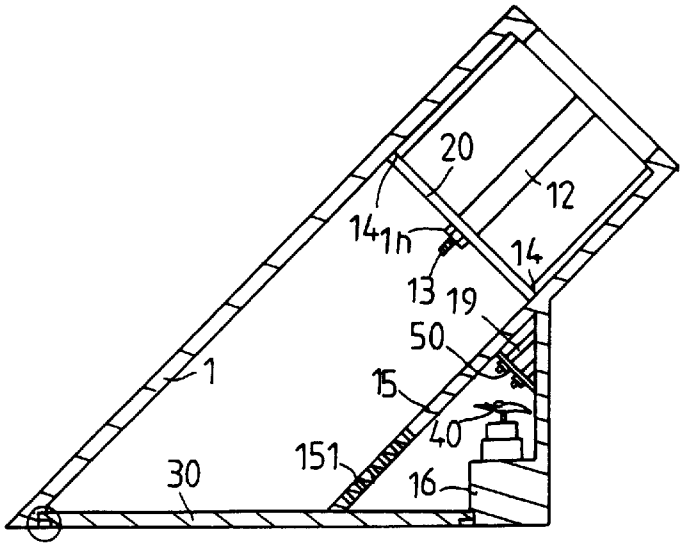
FIG. 2 is a schematic plan view of a knife holder of a first preferred embodiment in accordance with the present invention.

Referring to FIGS. 1 to 2A, a first knife holder comprises a hollow casing 1, a positioning plate 20 disposed in the hollow casing 1, and a base plate 30 disposed on a bottom of the hollow casing 1. The base plate 30 has a periphery recess 31. The positioning plate 20 has a center hole 21, an oblong aperture 23, and a plurality of slot apertures 22. An oblong hole 10 is formed on a top portion of the hollow casing 1. A plurality of slot holes 11 are formed on the top portion of the hollow casing 1. A post 12 extends downward from an upper portion of the hollow casing 1. The post 12 has a threaded end 13 inserted in the center hole 21 and fastened by a first nut 1*n*. The hollow casing 1 has a periphery flange 18 engaging with the periphery recess 31. The periphery flange 18 has two protruded bars 180.

Four step flanges 14 are disposed on four upper inner corners of the hollow casing 1 to block the positioning plate 20.

A separation plate 15 is disposed on a lateral of the hollow casing 1. The separation plate 15 has a plurality of through holes 151.

A hollow seat 150 is connected to the separation plate 15. A cell chamber 16 is formed in the hollow seat 150. The cell chamber 16 receives a cell 6. A cell chamber cover 161 covers the cell chamber 16. A fan 40 is disposed in the hollow seat 150. Two pillars 19 are disposed in an inner periphery of the hollow seat 150. A switch 17 is disposed on the hollow seat 150. An electrothermal device 50 is confined between the pillars 19. The electrothermal device 50 has two round apertures 52 receiving the pillars 19. Two second nuts 1*m* fasten the pillars 19 and the electrothermal device 50 together. An electric wire 510 is connected to a plug 51 and the electrothermal device 50.

Figure 3:
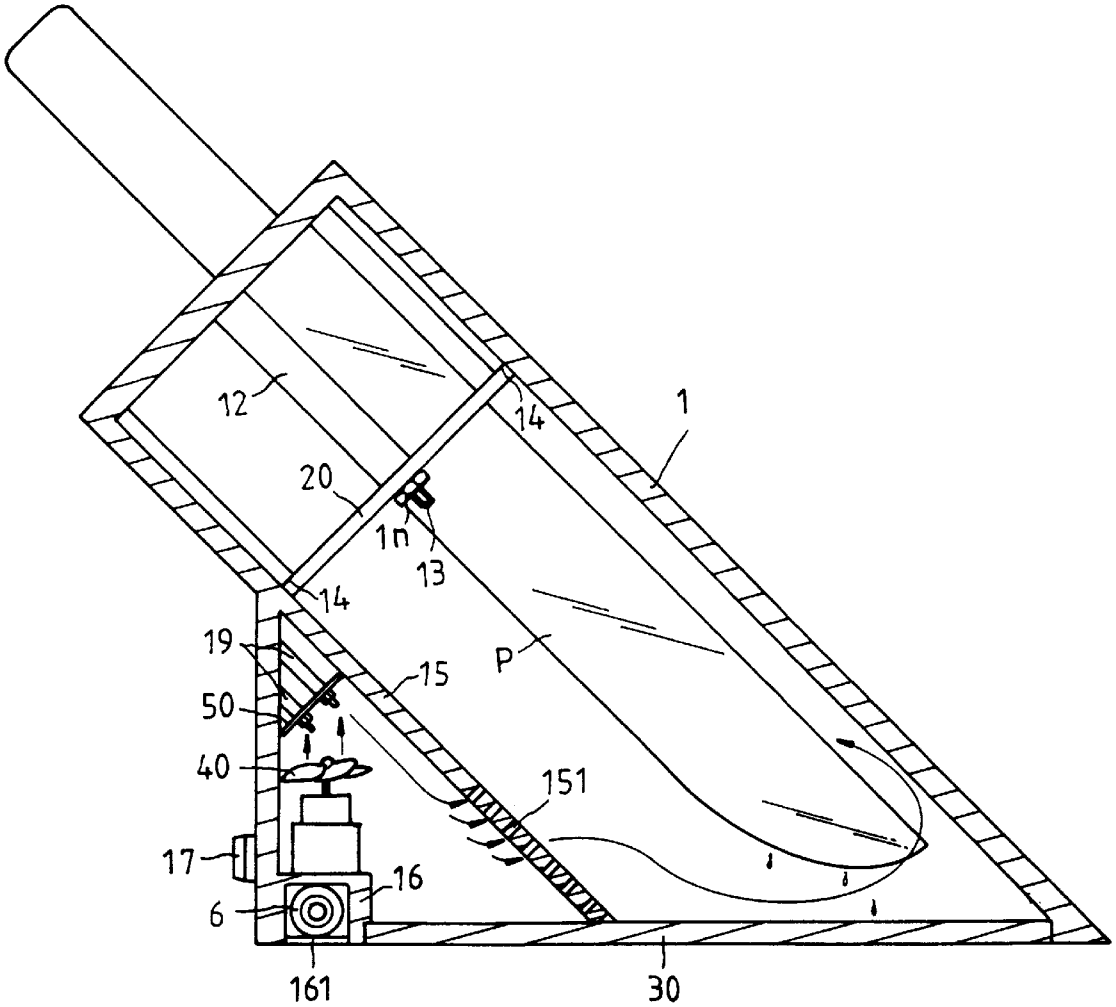
FIGS. 3 and 3A are schematic views illustrating an application of a knife holder of a first preferred embodiment in accordance with the present invention.
Figure 3A:
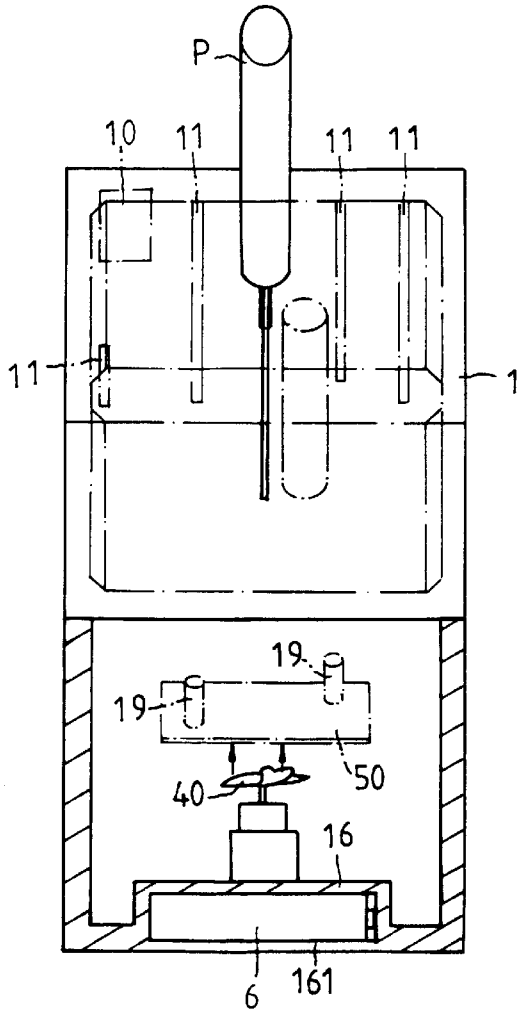

Referring to FIGS. 3 and 3A, a knife P is inserted in the first knife holder via one of the slot holes 11 and one of the slot apertures 22.

Figure 4:
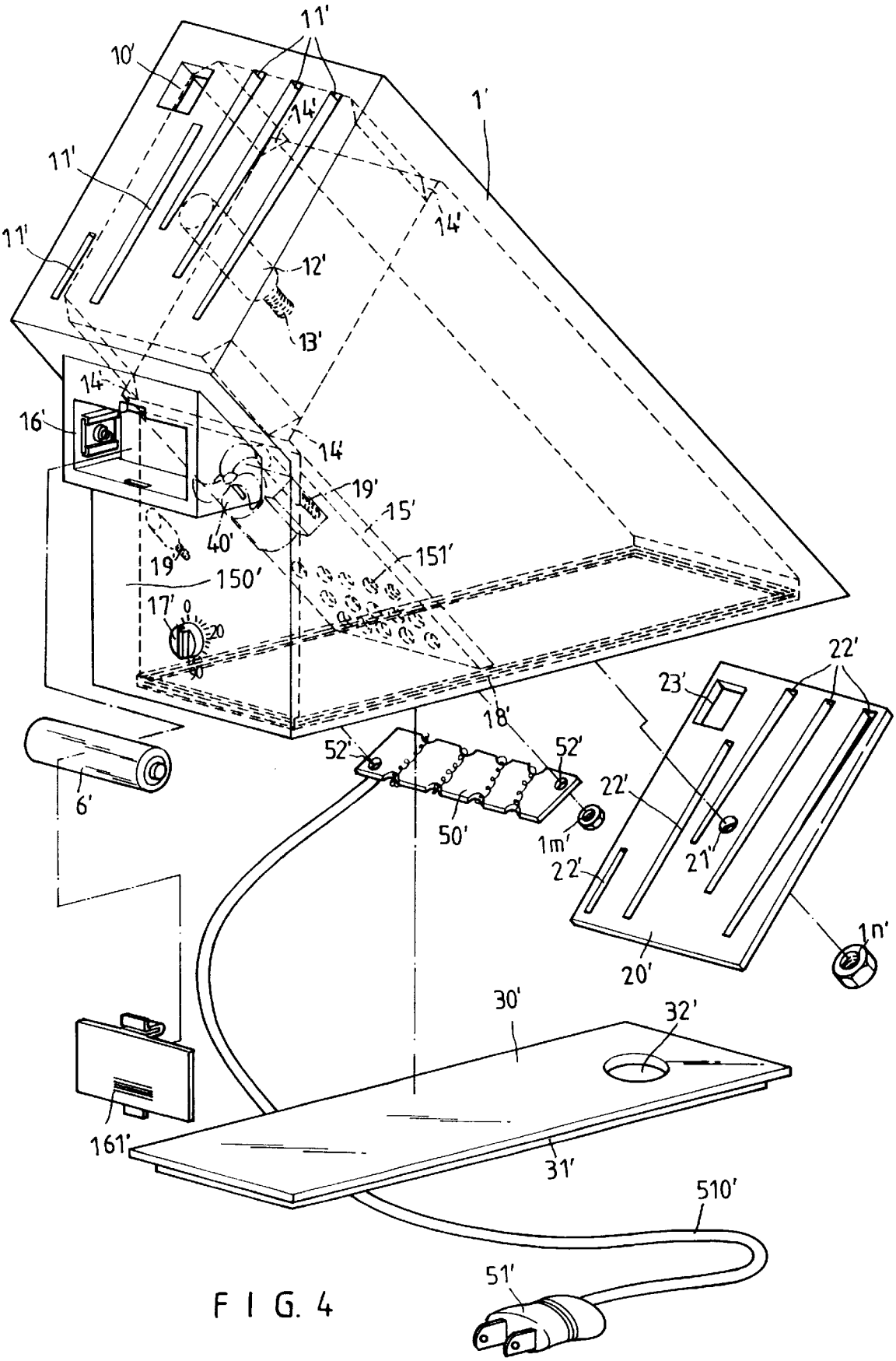
FIG. 4 is a perspective exploded view of a knife holder of a second preferred embodiment in accordance with the present invention.
Figure 4A:
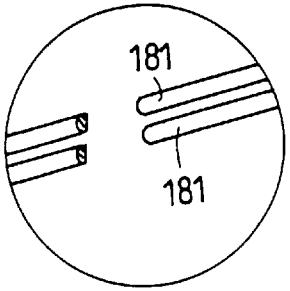
FIG. 4A is an enlarged perspective view of two protruded bars of a knife holder of a second preferred embodiment.
Figure 5A:
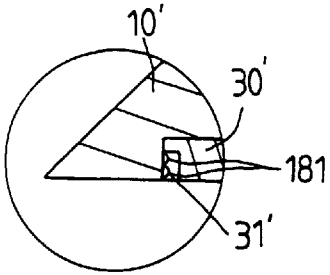
FIG. 5A is a schematic view illustrating an engagement of a protruded bar and a periphery recess in FIG. 5.
Figure 5:
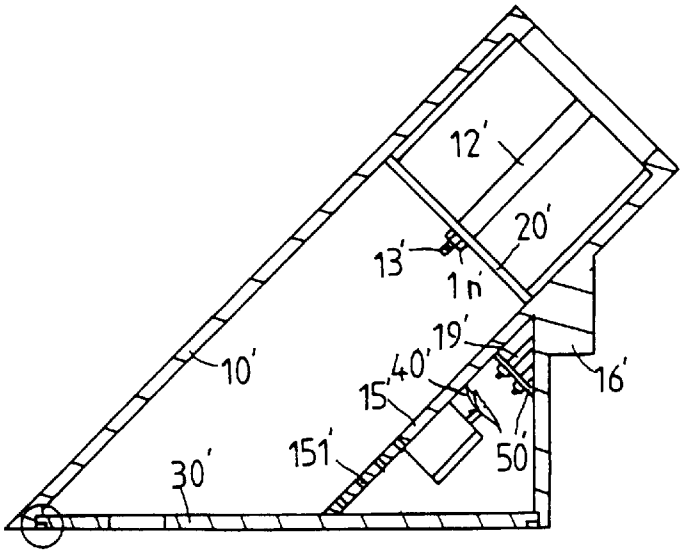
FIG. 5 is a schematic plan view of a knife holder of a second preferred embodiment in accordance with the present invention.

Referring to FIGS. 4 to 5A, a second knife holder comprises a hollow casing 1', a positioning plate 20' disposed in the hollow casing 1', and a base plate 30' disposed on a bottom of the hollow casing 1'. The base plate 30' has a circular hole 32' and a periphery recess 31'. The positioning plate 20' has a center hole 21', an oblong aperture 23', and a plurality of slot apertures 22'. An oblong hole 10' is formed on a top portion of the hollow casing 1'. A plurality of slot holes 11' are formed on the top portion of the hollow casing 1'. A post 12' extends downward from an upper portion of the hollow casing 1'. The post 12' has a threaded end 13' inserted in the center hole 21' and fastened by a first nut 1*n*'. The hollow casing 1' has a periphery flange 18' engaging with the periphery recess 31'. The periphery flange 18' has two protruded bars 181. Four step flanges 14' are disposed on four upper inner corners of the hollow casing 1' to block the positioning plate 20'.

A separation plate 15' is disposed on a lateral of the hollow casing 1'. The separation plate 15' has a plurality of through holes 151'.

A hollow seat 150' is connected to the separation plate 15'. A cell chamber 16' is disposed on the hollow seat 150'. The cell chamber 16' receives a cell 6'. A cell chamber cover 161' covers the cell chamber 16'. A fan 40' is disposed in the hollow seat 150'. Two pillars 19' are disposed in an inner periphery of the hollow seat 150'. A switch 17' is disposed on the hollow seat 150'. An electrothermal device 50' is confined between the pillars 19'. The electrothermal device 50' has two round apertures 52' receiving the pillars 19'. Two second nuts 1*m*' fasten the pillars 19' and the electrothermal device 50' together. An electric wire 510' is connected to a plug 51' and the electrothermal device 50'.

Figure 6:
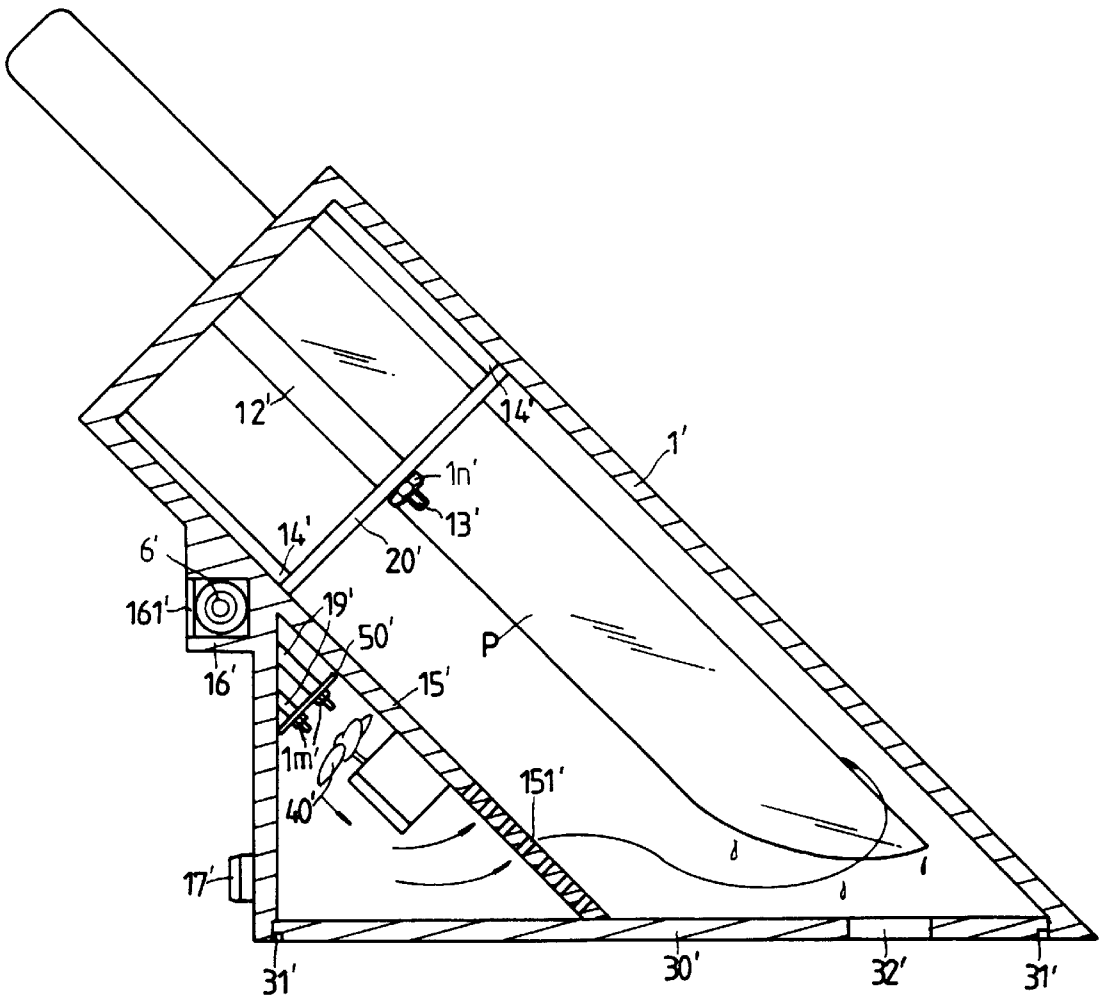
FIGS. 6 and 6A are schematic views illustrating an application of a knife holder of a second preferred embodiment in accordance with the present invention.
Figure 6A:
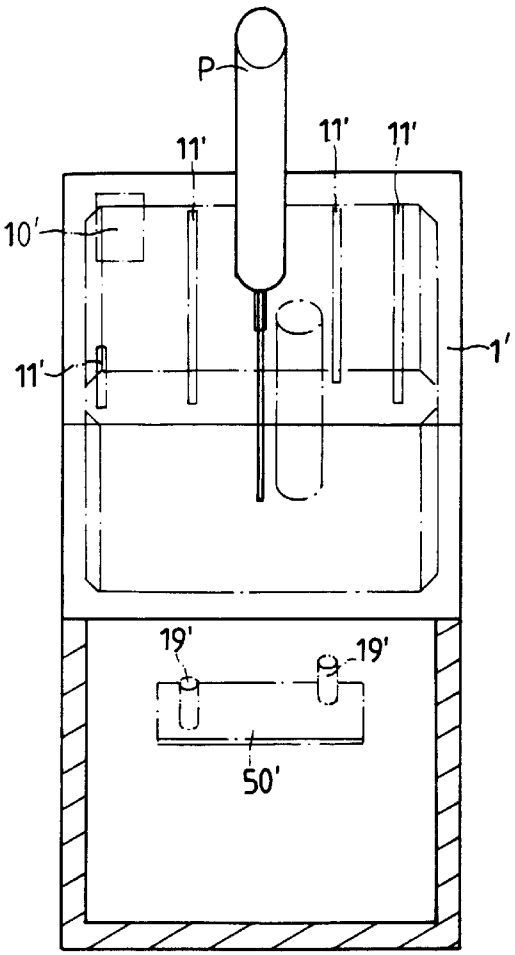

Referring to FIGS. 6 and 6A, a knife P is inserted in the first knife holder via one of the slot holes 11' and one of the slot apertures 22'.

Figure 7:
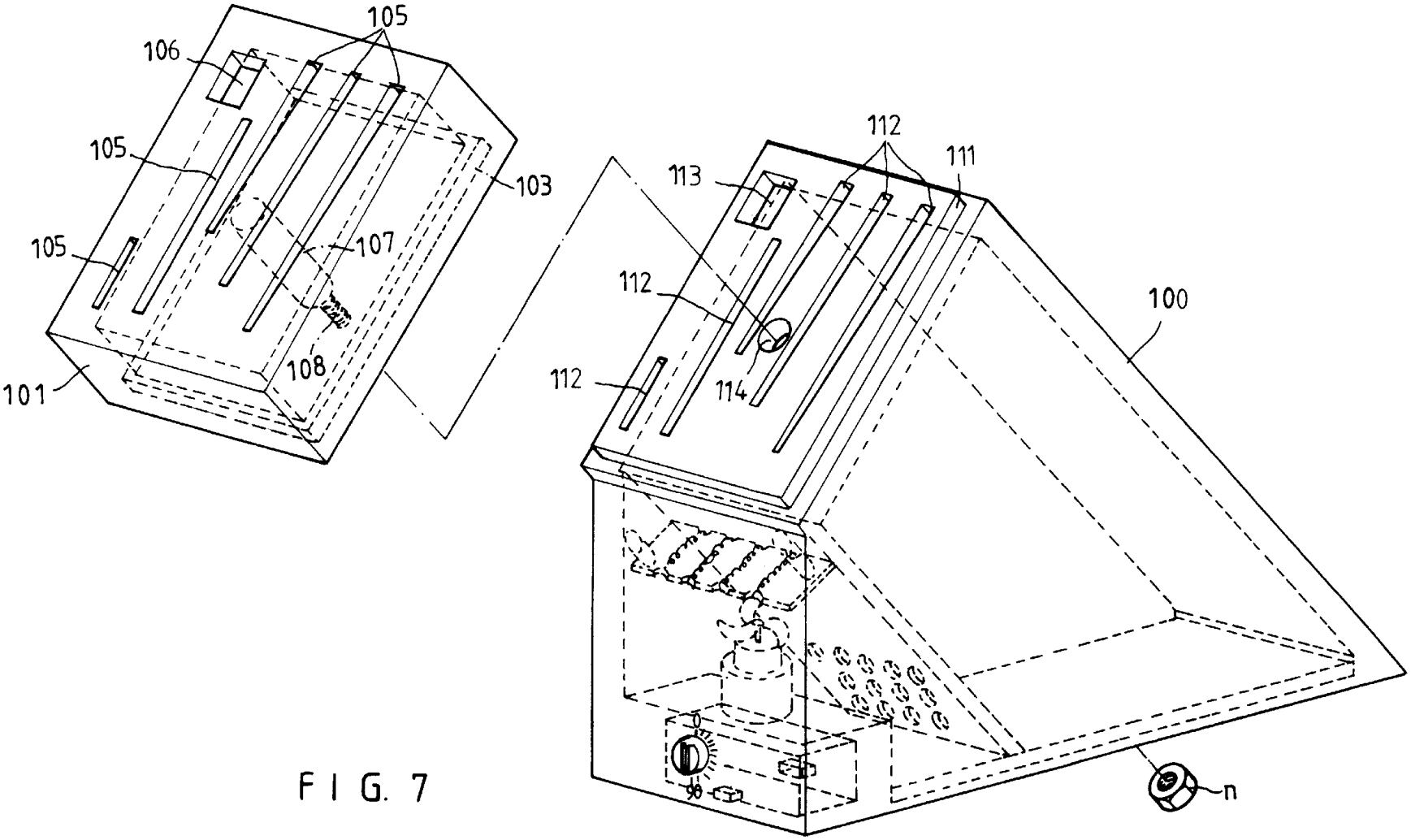
FIG. 7 is a perspective exploded view of a knife holder of a third preferred embodiment in accordance with the present invention.

Referring to FIG. 7, a third knife holder comprises a hollow casing 100 and an upper cover 101. The hollow casing 100 comprises an upper periphery flange 111, a center hole 114, an oblong aperture 113, and a plurality of slot apertures 112. The upper cover 101 comprises an oblong hole 106, a plurality of slot holes 105, and a periphery groove 103. A post 107 extends downward from an upper portion of the upper cover 101. The post 107 has a threaded end 108 inserted in the center hole 114 and fastened by a nut n. The upper cover 101 covers the hollow casing 100. The periphery flange 111 engages with the periphery groove 103.

Figure 8:
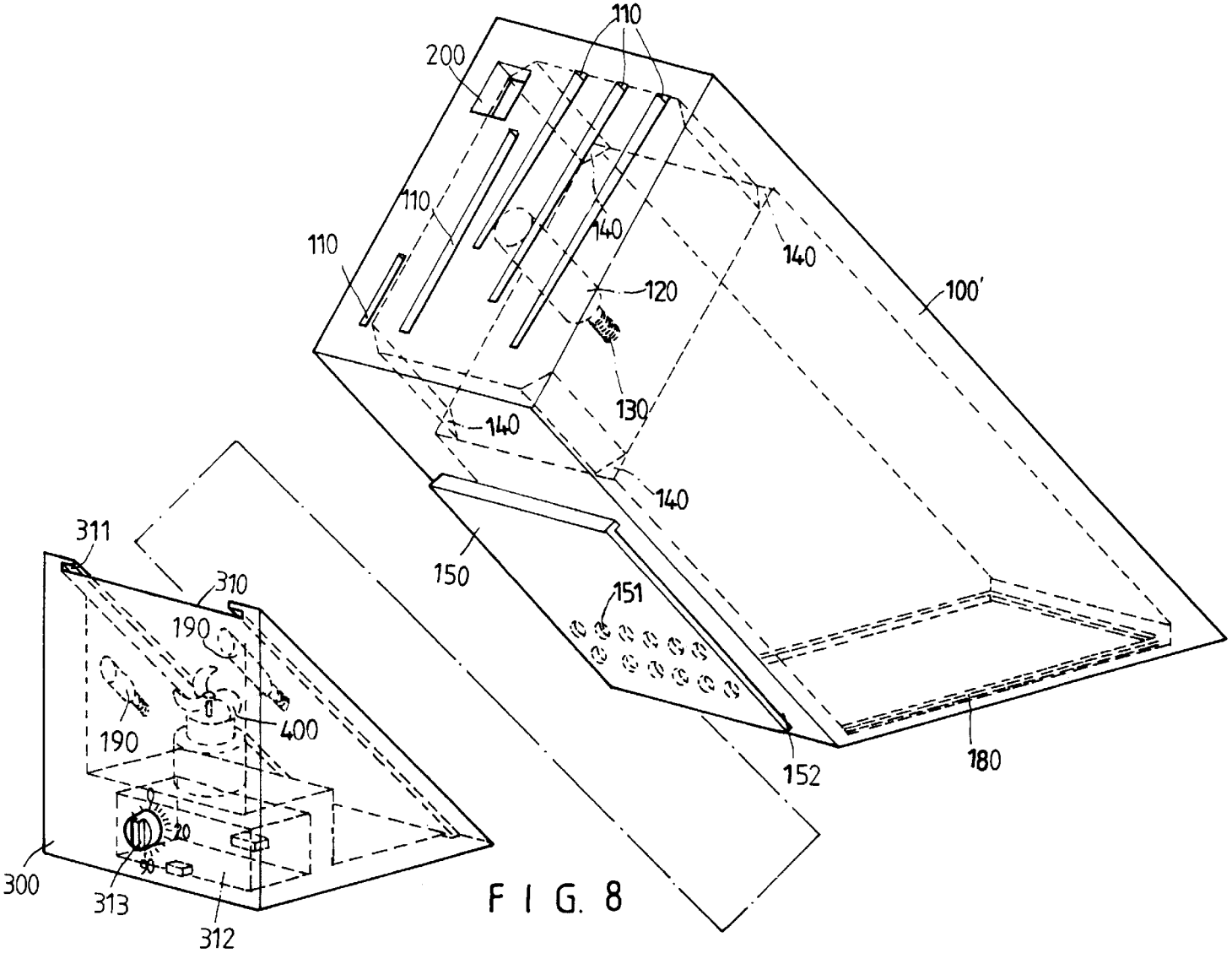
FIG. 8 is a perspective exploded view of a knife holder of a fourth preferred embodiment in accordance with the present invention.

Referring to FIG. 8, a fourth knife holder comprises a hollow casing 100', an oblong hole 200 formed on a top portion of the hollow casing 100'. A plurality of slot holes 110 formed on the top portion of the hollow casing 100'. A post 120 extends downward from an upper portion of the hollow casing 100'. The post 120 has a threaded end 130. The hollow casing 100' has a periphery flange 180. A separation plate 150 is disposed on a lateral of the hollow casing 100'. The separation plate 150 has two flanges 152 and a plurality of through holes 151. A hollow seat 300 is connected to the separation plate 150. A cell chamber 312 is formed in the hollow seat 300. A fan 400 is disposed in the hollow seat 300. Two pillars 190 are disposed in an inner periphery of the hollow seat 300. A switch 313 is disposed on the hollow seat 300. The hollow seat 300 has a slant face 310. Two slide grooves 311 are formed on the slant face 310 to receive the flanges 152.

The hollow casing is made of thermosetting plastics such as phenol-formaldehyde resins, urea-formaldehyde resins, and melamine-formaldehyde resins. Sandalwood powders, camphorwood powders, and camphor powders can be added into the composition of the thermosetting plastics. The hollow casing can be formed by an injection molding method.

The invention is not limited to the above embodiment but various modification thereof may be made. Further, various changes in form and detail may be made without departing from the scope of the invention.

I claim:

1. A knife holder comprising:

a hollow casing, a positioning plate disposed in the hollow casing, a base plate disposed on a bottom of the hollow casing, the base plate having a periphery recess, the positioning plate having a center hole, an oblong aperture, and a plurality of slot apertures, an oblong hole formed on a top portion of the hollow casing, a plurality of slot holes formed on the top portion of the hollow casing, a post extending downward from an upper portion of the hollow casing, the post having a threaded end inserted in the center hole and fastened by a nut, the hollow casing having a periphery flange engaging with the periphery recess.

2. A knife holder as claimed in claim 1, wherein four step flanges are disposed on four upper inner corners of the hollow casing to block the positioning plate.

3. A knife holder as claimed in claim 1, wherein a separation plate is disposed on a lateral of the hollow casing, and the separation plate has a plurality of through holes.

4. A knife holder as claimed in claim 3, wherein a hollow seat is connected to the separation plate, a cell chamber is formed in the hollow seat to receive a cell, a cell chamber cover covers the cell chamber, a fan is disposed in the hollow seat, two pillars are disposed in an inner periphery of the hollow seat, a switch is disposed on the hollow seat, and an electrothermal device is confined between the pillars.

* * * * *